US010950918B1

(12) United States Patent
Wu et al.

(10) Patent No.: US 10,950,918 B1
(45) Date of Patent: Mar. 16, 2021

(54) DUAL-MODE MONOBLOCK DIELECTRIC FILTER

(71) Applicant: The Chinese University of Hong Kong, Shatin (CN)

(72) Inventors: Ke-Li Wu, Shatin (CN); Yuliang Chen, Yangzhou (CN); Yan Zhang, Nanjing (CN)

(73) Assignee: The Chinese University of Hong Kong, Shatin (CN)

( * ) Notice: Subject to any disclaimer, the term of this patent is extended or adjusted under 35 U.S.C. 154(b) by 0 days.

(21) Appl. No.: 16/700,016

(22) Filed: Dec. 2, 2019

(51) Int. Cl.

| | |
|---|---|
| ***H01P 1/20*** | (2006.01) |
| ***H01P 1/208*** | (2006.01) |
| ***H01P 1/205*** | (2006.01) |
| ***H01P 7/10*** | (2006.01) |

(52) U.S. Cl.
CPC ..... *H01P 1/2086* (2013.01); *H01P 1/2002* (2013.01); *H01P 1/2053* (2013.01); *H01P 7/105* (2013.01)

(58) Field of Classification Search
CPC .... H01P 1/2086; H01P 1/2084; H01P 1/2002; H01P 1/2053; H01P 1/2056; H01P 1/202; H01P 1/201; H01P 1/20; H01P 7/10; H01P 7/105
USPC .... 333/212, 202, 208, 209, 219, 219.1, 222, 333/223, 206, 207, 227, 230
See application file for complete search history.

(56) References Cited

U.S. PATENT DOCUMENTS

| | | | | |
|---|---|---|---|---|
| 6,661,310 | B2 * | 12/2003 | Okada | H01P 1/2136 333/134 |
| 9,190,705 | B2 | 11/2015 | Wu et al. | |
| 2008/0231391 | A1 * | 9/2008 | Takubo | H01P 1/2056 333/134 |
| 2015/0035626 | A1 * | 2/2015 | Tomaki | H01P 1/2002 333/219 |
| 2016/0099492 | A1 * | 4/2016 | Yuan | H01P 1/2002 333/134 |

FOREIGN PATENT DOCUMENTS

| | | | |
|---|---|---|---|
| WO | 2017/088174 | A1 | 6/2017 |
| WO | 2017/088195 | A1 | 6/2017 |

OTHER PUBLICATIONS

Kojima, et al. "A Compact 28GHz Bandpass Filter using Quartz Folded Waveguide." In 2018 IEEE/MTT-S International Microwave Symposium—IMS, pp. 1110-1113. IEEE, 2018.

(Continued)

*Primary Examiner* — Stephen E. Jones
(74) *Attorney, Agent, or Firm* — Kilpatrick Townsend & Stockton LLP

(57) ABSTRACT

A dual-mode dielectric resonator using two dissimilar modes is described, the dissimilar modes supported by a ridge waveguide resonator and a ½-wavelength metalized cylindrical resonator within a single, metal-coated dielectric block. Each ridge waveguide resonator and cylindrical resonator form a resonator pair. Multiple pairs of ridge waveguide/cylindrical resonators are fabricated in the same dielectric block to form an 8-pole dielectric resonator filter for 5G or other applications. Transmission zeros can be positioned by the location of feeding probes along the cylindrical resonators.

21 Claims, 8 Drawing Sheets

RESONATOR PAIR

(56) References Cited

OTHER PUBLICATIONS

Matsutani, et al. "Miniaturized Quartz Waveguide Filter using Double-Folded Structure," 2019 IEEE/MTT-S International Microwave Symposium, 1201-1204.
Onaka, et al. "28 GHz wideband filter using quartz crystal waveguide for massive MIMO antenna unit." In 2017 IEEE MTT-S International Microwave Symposium (IMS), pp. 1468-1471. IEEE, 2017.
Pelliccia, et al. "Ultra-compact pseudoelliptic waveguide filters using TM dual-mode dielectric resonators." In Asia-Pacific Microwave Conference 2011, pp. 143-146. IEEE, 2011.
Rong, et al. "LTCC wide-band ridge-waveguide bandpass filters." IEEE transactions on microwave theory and techniques 47, No. 9 (1999): 1836-1840.
San Blas, et al. "Novel Solution for the Coaxial Excitation of Inductive Rectangular Waveguide Filters." In 2018 48th European Microwave Conference (EuMC), pp. 89-92. IEEE, 2018.

* cited by examiner

RESONATOR PAIR

DUAL-MODE MONOBLOCK DIELECTRIC FILTER

CROSS-REFERENCES TO RELATED APPLICATIONS

NOT APPLICABLE

STATEMENT AS TO RIGHTS TO INVENTIONS MADE UNDER FEDERALLY SPONSORED RESEARCH AND DEVELOPMENT

NOT APPLICABLE

BACKGROUND

1. Field of the Invention

The present application generally relates to dielectric resonator filters and dielectric resonator antennas. Specifically, the application is related to a dual-mode dielectric resonator having a dielectric ridge waveguide resonator and a metalized half-wavelength long cylindrical resonator.

2. Description of the Related Art

A microwave filter is often an essential component in wireless communication systems. To achieve a low insertion loss using high Q resonators, the metallic cavity filter has been widely used for cellular communication base stations due to its mature fabrication technique and low cost. However, its bulkiness restricts its application in fifth generation (5G) and future wireless system base stations. Those stations involve a Multi-Input Multi-Output (MIMO) array antenna that contains tens or even more than a hundred antenna elements, and each antenna element is cascaded with a high performance microwave filter. In a MIMO array antenna, due to the restriction on the size and weight of microwave components, filters should be compact and lightweight. Therefore, researchers are looking for a compromise between high Q and compact volumes.

FIG. 1 is redrawn to more clearly show technical features from San Blas, A. A., et al. "Novel Solution for the Coaxial Excitation of Inductive Rectangular Waveguide Filters," 2018 48*th European Microwave Conference* (*EuMC*), FIG. 2, 2018. The figure shows a hollow metallic cavity filter employing a mixed mode resonator. The metallic cavity filter consists of a three-quarter-wavelength (¾λ) long coaxial resonator and a rectangular waveguide resonator for feeding an air-filled metal waveguide filter. In this configuration, the three-quarter-wavelength (in air) long coaxial resonator is short circuited at one end and open circuited on the other. The metal cylindrical post of the coaxial resonator is inserted horizontally in a rectangular waveguide resonator. The coaxial resonator supports a transverse electromagnetic (TEM) mode, and the waveguide resonator supports a transverse electric (TE) 101 mode, or $TE_{101}$ mode. The two dissimilar modes are coupled through a tuning screw inserted from the top metallic lid, forming a dual-mode resonator. The dual-mode resonator serves as an input/output (I/O) resonator, while the waveguide resonators are conventional single mode resonators.

Wavelengths of electromagnetic radiation are shorter in a dielectric material than in air or in a vacuum. A wavelength in a dielectric material is shortened by the square root of relative permittivity times, i.e., $\Delta_d=\lambda_0/\sqrt{\varepsilon_r}$, where $\lambda_0$ is the wavelength in air, $\lambda_d$ is the wavelength in dielectric materials, and $\varepsilon_r$ is the relative permittivity of the dielectric material. Filters that employ solid dielectrics can be smaller than their air cavity counterparts. A "wavelength" or "operating wavelength" in a dielectric device thus refers to the wavelength in the dielectric, not in the air or a vacuum.

FIG. 2 was drawn by reverse engineering a physical, commercial filter. The design embodies some of the various single mode dielectric structures found in references i) International Patent Publication No. WO 2017/088195 A1 to Qiu et al., titled "Dielectric Resonator and Filter," ii) International Patent Publication No. WO 2017/088174 A1 to Zhang et al., titled "Dielectric Filter, Transceiver and Base Station," and iii) U.S. Pat. No. 9,998,163 to Yuan, titled "Filter and Transceiver Comprising Dielectric Body Resonators Having Frequency Adjusting Holes and Negative Coupling Holes." Each of these references is assigned to Huawei Technologies Co., Ltd. There are a multitude of ridge waveguide resonators formed in the top with dielectric windows between.

The Qiu reference discloses a single mode dielectric resonator comprising a main body and a surrounding wall, which is arranged on a surface of the main body in a protruding manner. The dielectric resonator improves the energy leakage problem between open circuit faces and pushes the harmonic wave far away from passband.

The Zhang and Yuan references disclose dielectric resonators with adjusting holes located on their body, each adjusting hole forming a resonant cavity together with the portion of the body around the adjusting hole. Moreover, a blind hole is introduced between every two resonant cavities that are not adjacent to each other.

While each of the disclosed devices above have their strengths, there is a need in the art for more compact resonators.

BRIEF SUMMARY

Generally described is a dielectric resonator block on which is formed a dielectric ridge waveguide depression and in which is formed a metalized half-wavelength (½λ) long cylindrical resonator. The dielectric ridge waveguide depression is a 90° straight-down, prismatic depression, geometrically akin to a "right prism." In operation, the ridge waveguide resonator is dominated by transverse electric ($TE_{101}$) modes. The cylindrical resonator is shaped like a cylinder on its side and has one end electrically isolated from a thin metal coating that covers the outside of the dielectric resonator block. In operation, the cylindrical resonator supports transverse electromagnetic (TEM) modes. The relative position of the ridge waveguide resonator and the cylindrical resonator affect coupling between the $TE_{101}$ and TEM modes. Together, the ridge waveguide resonator and the cylindrical resonator form a resonator pair.

Multiple dielectric resonator pairs in accordance with the above can be formed in the same physical block of dielectric with partial windows formed between them. For example, 4 resonator pairs can form an 8-pole dielectric resonator filter. Each pair can couple $TE_{101}$ and/or TEM modes to the same type of mode in an adjacent pair.

Some embodiments of the present invention are related to a dielectric resonator filter apparatus comprising a dielectric block having a top and sides, a right prism depression in the top of the dielectric block, a horizontal cylindrical cavity within the dielectric block, the horizontal cylindrical cavity having an axis that is parallel with the top of the dielectric block, a first conductive layer covering the dielectric block and the right prism depression, and a second conductive layer covering an inside surface of the horizontal cylindrical cavity, wherein the first conductive layer is electrically isolated from the second conductive layer. The right prism depression is a ridge waveguide resonator that, in operation, is dominated by a transverse electric ($TE_{101}$) mode, and the horizontal cylindrical cavity is configured to support a transverse electromagnetic (TEM) mode of electromagnetic waves within operating wavelengths of the dielectric resonator filter apparatus. The right prism depression is configured to affect electromagnetic coupling between the $TE_{101}$ and TEM modes.

A length of the horizontal cylinder can be about one half of the operating wavelengths in the nominal pass band, which saves volume in the dielectric block.

The apparatus can include an opening from an outside of the dielectric block to the horizontal cylindrical cavity. The horizontal cylindrical cavity can extend to one of the sides of the dielectric block and form the opening, or it can be buried inside. An annular, insulative gap can exist between the first conductive layer and the second conductive layer.

The apparatus can include a coaxial feeding probe extending from an outside of the dielectric block to one of the sides or a bottom of the horizontal cylindrical cavity.

The right prism depression and the horizontal cylindrical cavity can constitute a first resonator pair, the right prism depression being a first right prism depression, and the horizontal cylindrical cavity being a first horizontal cylindrical cavity, and the apparatus can further include a second resonator pair in the dielectric block comprising a second right prism depression in the top of the dielectric block and a second horizontal cylindrical cavity within the dielectric block, and a partial-width dielectric window between the first and second resonator pairs, the partial-width dielectric window formed by a conductive, vertical channel in one or more of the sides of the dielectric block.

Axes of the first and second cylindrical cavities can be parallel, and the first and second cylindrical cavities can extend from a common side of the dielectric block. Axes of the first and second cylindrical cavities can be parallel, and the first and second cylindrical cavities can extend from opposite sides of the dielectric block. Axes of the first and second cylindrical cavities can be perpendicular to one another. The first and second cylindrical cavities can share a common axis, the first and second cylindrical cavities can extend from opposite sides of the dielectric block, and the conductive, vertical channel can bisect the common axis between the first and second cylindrical cavities.

The apparatus can include a third resonator pair in the dielectric block comprising a third right prism depression and a third horizontal cylindrical cavity, a fourth resonator pair in the dielectric block comprising a fourth right prism depression and a fourth horizontal cylindrical cavity, and partial-width dielectric windows between multiple of the resonator pairs, each partial-width dielectric window formed or otherwise defined by a conductive, vertical channel in one or more of the sides of the dielectric block, wherein axes of the first and second cylindrical cavities are perpendicular, axes of the second and third cylindrical cavities are parallel, and axes of the third and fourth cylindrical cavities are perpendicular, whereby the first, second, third, and fourth resonator pairs form (at least) an 8-pole dielectric resonator filter.

The apparatus can further include a first feeding probe extending from outside the dielectric block to the first cylindrical cavity and a second feeding probe extending from the outside to the fourth cylindrical cavity. The first and second feeding probes can extend to a bottom of the dielectric block. The first and second feeding probes can extend to one or more of the sides of the dielectric block, and the apparatus can further include flat conductive traces extending from the first and second feeding probes on the sides of the dielectric block to a bottom of the dielectric block, the flat conductive traces being suitable for surface mounting of the dielectric resonator filter apparatus.

The right prism depression can have a cross section of a circle, rectangle, or square, among other closed shapes. The cross section can be rectangular or square, which normally have sharp corners, yet have filleted or chamfered corners. The dielectric block can be rectangular. The dielectric block can include a material selected from the group consisting of ceramic, glass, or a polymer.

A transceiver can comprise the dielectric resonator filter apparatus described above, and a base station can comprise the transceiver.

DETAILED DESCRIPTION

Figure 1:
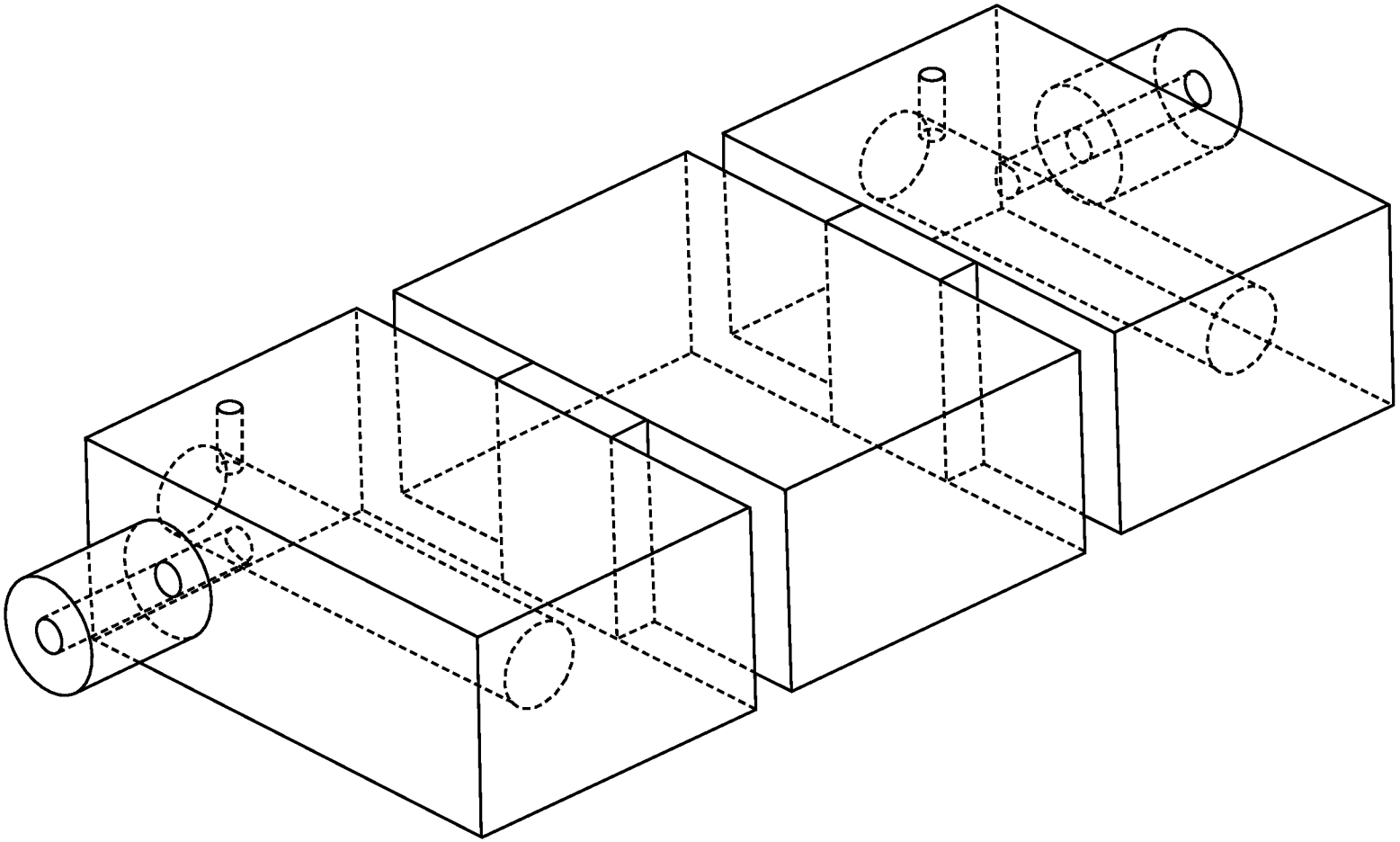
FIG. 1 (PRIOR ART)
FIG. 1 is an isometric view of a hollow metallic cavity filter of the prior art.
Figure 2:
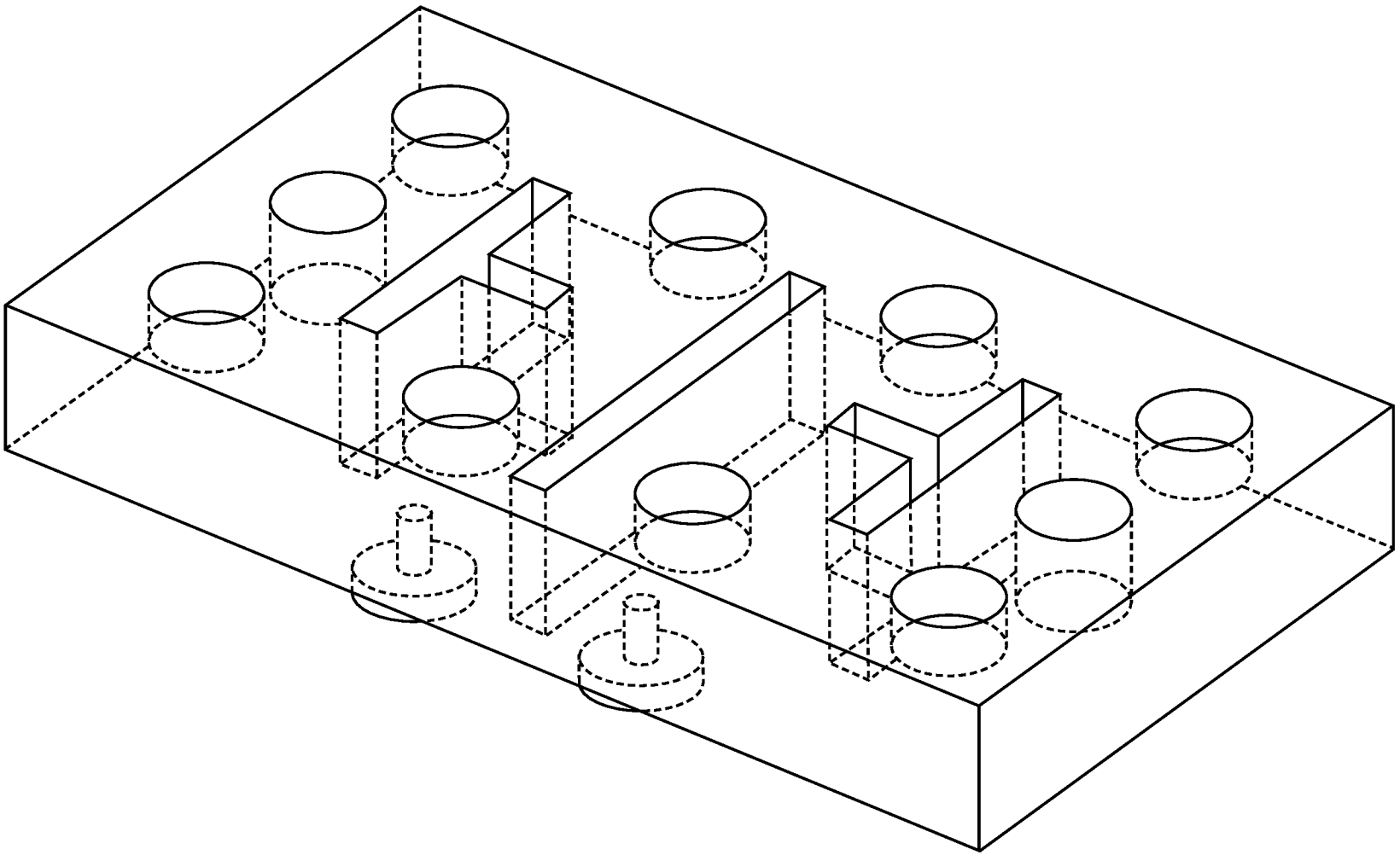
FIG. 2 (PRIOR ART)
FIG. 2 is an isometric view of a dielectric resonator filter with dielectric ridge waveguide resonators of the prior art.

Disclosed herein is an advanced miniaturization technology and design methods for microwave dielectric filters in wireless communication base station equipment, particularly for the systems where Multi-Input Multi-Output (MIMO) and Massive-MIMO (M-MIMO) array antennas are used.

A dual-mode dielectric resonator is described that has potential for applications in fifth generation (5G) wireless communication base stations, where massive MIMO array antennas are used, and compact microwave filters are highly desirable.

Using degenerate modes in the same resonator can support more than one electrical resonator in the same volume. Degenerate modes are modes that possess the same resonant frequency and orthogonal as well as the same mode field distribution. Such a resonator shared by two degenerate modes is called "dual-mode resonator."

A resonator that is shared by two non-degenerate modes but with the same resonant frequency and dissimilar mode field patterns is also called "dual-mode resonator." In recent years, various filter technologies employing dielectrics and/or degenerate modes have been employed for size reduction. Some embodiments of the invention take that to the next level, as can be appreciated from the following descriptions.

A smallest building block of the dual-mode dielectric resonator comprises a dielectric ridge waveguide resonator and a metalized half-wavelength long cylindrical resonator. The dielectric resonator supports two dissimilar resonant modes at the same frequency. As a result, two electrical resonators share the same volume. This can save on the order of 50% of the space of filters of the prior art.

Instead of a three-quarter-wavelength (¾λ) long coaxial TEM mode resonator as in the prior art, a half-wavelength (½λ) long coaxial TEM mode resonator is used. To support a half-wavelength long coaxial resonator, the two ends of the resonator should be open-circuited. A half-wavelength long length almost perfectly fits the width of a ridge loaded dielectric resonator whose dielectric constant is about 20. To create an open circuit on the conducting wall for the coaxial resonator, an annular metal cut-off around ring at the foot of the metalized cylinder of the coaxial resonator is introduced.

A ridge loaded waveguide resonator is used instead of rectangular waveguide resonator. With the loaded ridge, the coupling between the $TE_{101}$ resonant mode of the waveguide resonator and the TEM mode of the coaxial resonant mode can be more easily controlled by appropriately setting the location of the ridge post.

Unlike the disclosed application in San Blas et al., in which the TEM mode resonators are only used as the input/output (I/O) structure to excite the waveguide resonator mode, and the other waveguide resonators are still single-mode resonators, most all the physical resonators can be dual-mode resonators in the present embodiments.

Methods of creating transmission zeros using parasitic couplings between the I/O structure and the $TE_{101}$ mode of the ridged loaded waveguide resonators are also proposed.

Various possible coupling arrangements for the same type of resonant modes and dissimilar types of modes are described herein. By carefully controlling the cross couplings between the I/O points and the dual-modes, transmission zeros near the nominal pass band can be created, resulting in a high near-pass band rejection rate. With an appropriate assembly of the proposed dual-mode dielectric resonators, and accurate control of the couplings between the dielectric resonators, both symmetric and asymmetric filtering responses can be realized.

Technical advantages of the proposed dual-mode dielectric filter assembly embodiments are manifold. They employ a dual mode resonator that supports two dissimilar fundamental modes: a half-wavelength TEM mode, and a ridge loaded waveguide cavity mode. Because both of the modes are fundamental modes, inherently the filter can take less than 50% of the volume of prior art filters commonly in use for MIMO array antennas of 5G base stations. In this application, layouts of dual mode resonators for constructing a high order filter are described, each layout allowing relatively independent tuning of each variable, facilitating mass production of the filter. To improve the rejection rate near the pass band, transmission zeros can be introduced by using the preferred filter configuration, enabling the realization of both symmetric and asymmetric filtering responses.

According to some embodiments of the present invention, a novel dual-mode dielectric resonator is presented that includes a dielectric cavity coated with a conductive layer on the surface. A chamfered square ridge is formed along the vertical direction on the top surface of the cavity. A metal cylinder is buried along horizontal direction along a side surface of the cavity. The metal cylinder is about half a wavelength long in terms of the center frequency of the filter in the dielectric cavity, and its two ends are free from any electric contact to the conductive walls of the cavity. The diameter of the metal cylinder is electrically small, for example less than 0.1 wavelength. The ridge loaded dielectric cavity supports a $TE_{101}$ like mode, whereas the metal cylinder supports a TEM mode. The pairing form a dual-mode resonator, and each component of which forms an electric resonant circuit. The coupling of the two modes can be realized by adjusting the relative positions of the metal cylinder and the chamfered square ridge post According to some embodiments, a dielectric filter can include a plurality of dielectric resonators with a common conductive layer on the surface. A separating iris can be provided between each of two adjacent dielectric resonator cavities. Each of the dielectric resonators can include a separated dielectric cavity with the conductive layer on the surface, a chamfered square ridge inserted along the vertical direction from the top surface of the cavity, and an open ended metal cylinder buried along horizontal direction of a side surface of the cavity. In operation, each of the dielectric resonators can support a TEM mode and a $TE_{101}$ like mode, each of which forms an electric resonant circuit.

According to other embodiments, a method of designing and manufacturing a dielectric filter are provided. The method includes obtaining dimension parameters of the dielectric cavity, ridge and metal cylinder of each resonator, as well as the dimensions of the coupling irises, the spacing of the ridge and the metal cylinder for the filter based on required center frequency, bandwidth and return loss, and designing an appropriate layout arrangement of the dielectric cavity with minimum unwanted parasitic coupling.

It will be apparent to those skilled in the art that regarding the specification and practice of the present disclosure that various modifications and variations can be made to the disclosed assemblies and methods without departing from the scope of the disclosure. For example, forming a half a wavelength long metalized cylindrical hole, whose end inside the dielectric cavity is open and other end that is terminated on a surface of the dielectric cavity and is insulated against the metal surface of the cavity, instead of using a metallic cylinder embedded in the dielectric cavity, may also be an option. It is intended that the specification and examples be considered as exemplary only, with a true scope of the present disclosure being indicated by the claims and their equivalents.

Figure 3:
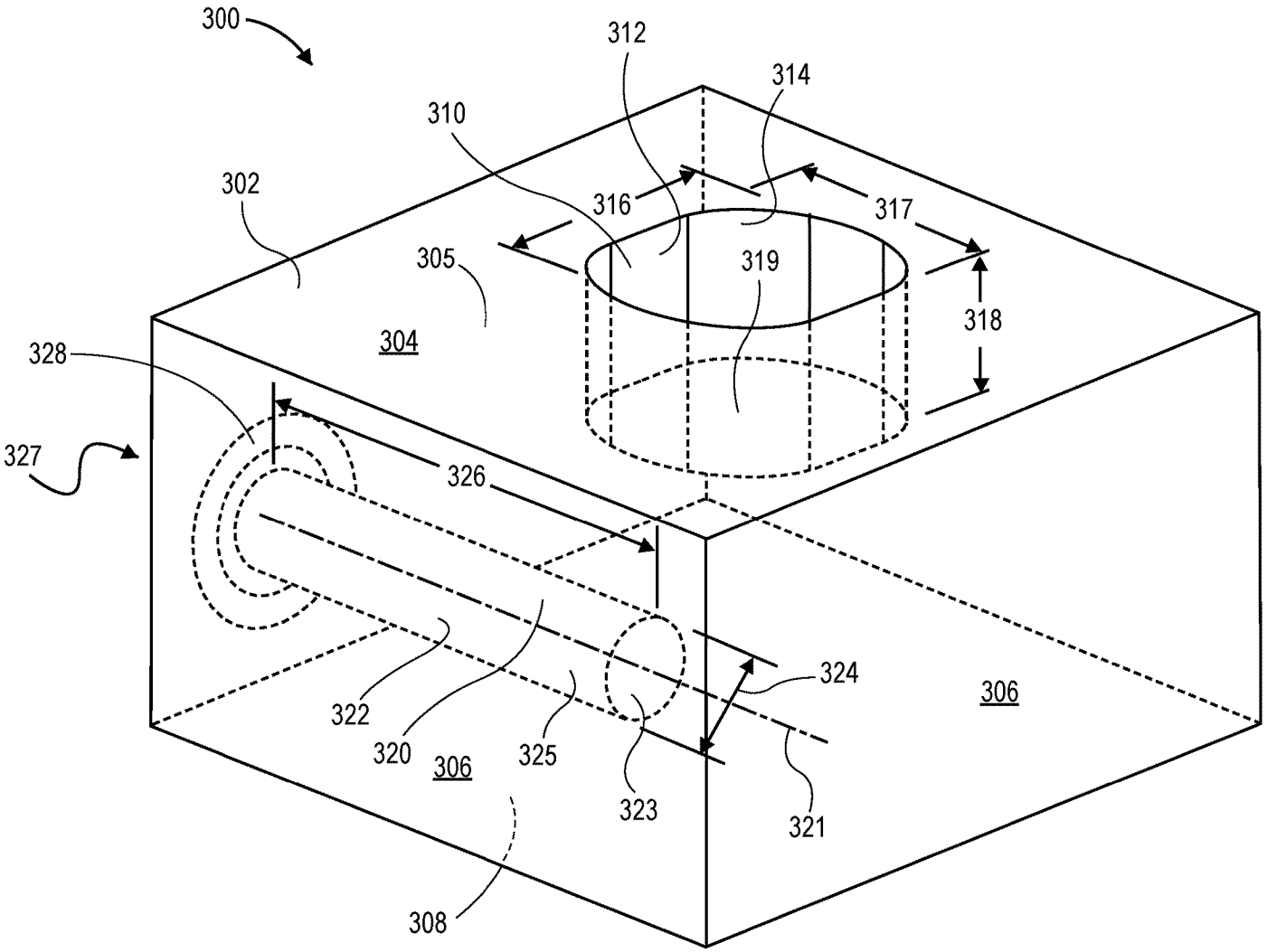
FIG. 3 is an isometric view of a resonator pair, including a dielectric resonator with a dielectric ridge waveguide resonator and a cylindrical resonator, in accordance with an embodiment.

FIG. 3 is an isometric view of a resonator pair, which we sometimes refer to as the smallest conceptual building block of later assemblies. Assembly 300 include rectangular-cubic dielectric block 302 having top 304, four sides 306, and bottom 308.

Within dielectric block 302 is right prism depression 310, also called a "ridge" or "ridge waveguide resonator." Being shaped like a right prism, ridge waveguide resonator 310 has 90-degree sides 312 and flat bottom 319. Flat bottom 319 is parallel with top 304 of the dielectric block. Width 316 and length 317 of the sides of the ridge waveguide resonator are equal in the exemplary embodiment. Depression 310 descends to depth 318.

A cross-section of depression 310 is largely square (with filleted corners), but it may also be rectangular, circular, or other closed shapes.

Radiused fillets 314 or chamfers on the four inside corners of the depression proof the dielectric block from cracking. Further, the radiuses may be artifacts of the manufacturing process and are not typically critical to the electrical design.

Conductive layer 305 covers top 304, sides 306, and bottom 308 of the dielectric block. The conductive layer entirely covers the surfaces within depression 310, including walls 312, fillets 314, and flat bottom 319.

Horizontal cylindrical cavity 320 extends from a back side 306 of the dielectric block and terminates as a blind hole. The cylindrical cavity has solid end 323 at one end and opening 327 to air at the other. It has smooth inner surface 322 around its diameter 324, all of the way to its depth 326 to end 323. Its axis 321 runs parallel with top 304, which is also parallel with bottom 308. In the exemplary embodiment, axis 321 parallels one of the sides 306.

Metalized conductive layer 325 covers the entirety of inside surface 322 and blind end 323, flaring a little ways out of back side 304. In order to electrically isolate conductive layer 325 from the rest of the block's conductive layer 305, annular, insulative gap 328 separates the two conductive layers on side 306. This forms an electrical open circuit for end 323 of the hole from the conducting outer walls.

Depth 326 of cylindrical cavity is approximately one-half of a wavelength (½λ) of an operating wavelength or frequency of the dielectric resonator. The selected frequency can be the center frequency of the filter's pass band. As dimensioned, cylindrical cavity 326 is configured to support TEM modes of electromagnetic waves, typically microwaves. It interacts with ridge waveguide resonator 310, which, in contrast to the cylindrical cavity, is dominated by $TE_{101}$ modes of the electromagnetic waves. The dielectric ridge waveguide resonator and the cylindrical resonator form a single resonator pair.

During operation, the cylindrical cavity supports a TEM mode, and the ridge loaded dielectric resonator depression supports a $TE_{101}$ like mode, each of which forms a resonant circuit. The coupling between two modes in the same cavity can be adjusted when designing the device by adjusting the relative position of the ridge depression/post and the metalized cylindrical hole.

Figure 4A:
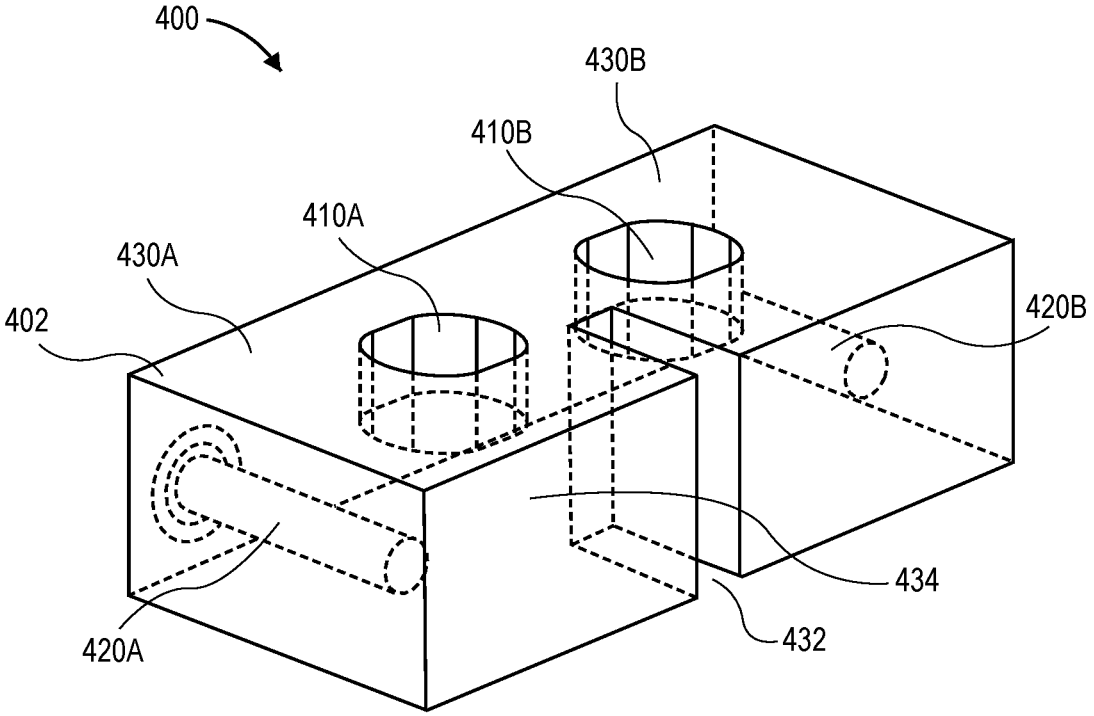
FIG. 4A is an isometric view of two resonator pairs separated by a partial-width dielectric window in accordance with an embodiment.
Figure 4B:
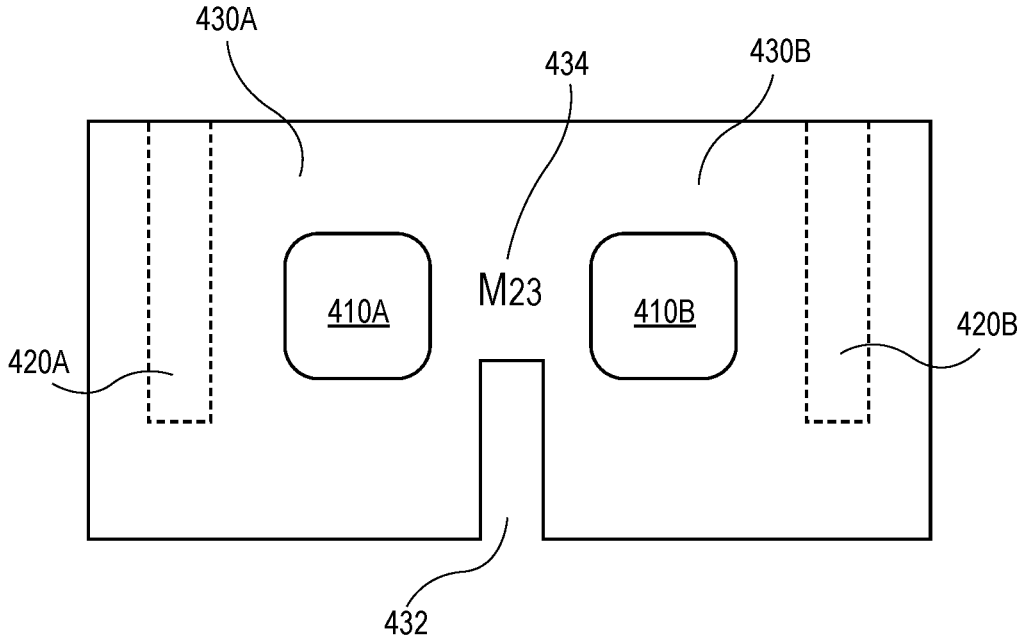
FIG. 4B is top down view of the two resonator pairs of FIG. 4A.

FIGS. 4A-4B illustrate two resonator pairs separated by a partial-width dielectric window. Assembly 400 includes dielectric block 402 in which is formed a first 'A' resonator pair 430A and a second 'B' resonator pair 430B. The entire outside of the dielectric block is metalized with a conductive coating except for annular gaps where metalized coatings on the inner surfaces of their cylindrical resonators are isolated. Thus, resonator pairs 430A and 430B not only share a common, integrated dielectric block, but also share the same outer conductive surface.

First resonator pair 430A includes ridge waveguide resonator 410A and horizontal cylindrical resonator 420A. Second resonator pair 430B includes ridge waveguide resonator 410B and horizontal cylindrical resonator 420B. Cylindrical resonators 420A and 420B extend from a common side, the back side, of dielectric block 402.

Partial-width dielectric window 434 is formed or otherwise defined between first and second resonator pairs 430A and 430B by conductive, vertical channel 432 in a front side of dielectric block 402. Because the sides of the channel are metalized (in addition to the air gap), that portion effectively blocks microwaves from direct transmission therethrough. Note that a line of sight between the blind ends of the cylindrical resonators is blocked by channel 432.

In this filter, the two resonator pairs 430A and 430B are arranged with the two ridge waveguide resonators 410A and 410B close to each other. The physical connection between two adjacent resonators is implemented with partial-width window 434. Meanwhile, the cylindrical resonators are parallel and do not substantially couple. Thus the $TE_{101}$ like mode in each of the two resonators can be coupled, and the coupling between the two TEM modes supported by the metalized cylindrical holes is minimized. During design, the coupling between the two $TE_{101}$ like modes can be adjusted by changing the width and thickness of the partial-width window.

FIGS. 5-8 illustrate different configurations of adjacent resonator pairs. The physical connection between two adjacent resonators is controlled by the dimension of a partial-width window between them. The coupling between two adjacent resonators is realized through direct coupling between i) two ridge waveguide resonators or ii) two metalized cylinders. In either coupling arrangement, the metalized cylinders can be arranged in different inserting directions.

Figure 5:
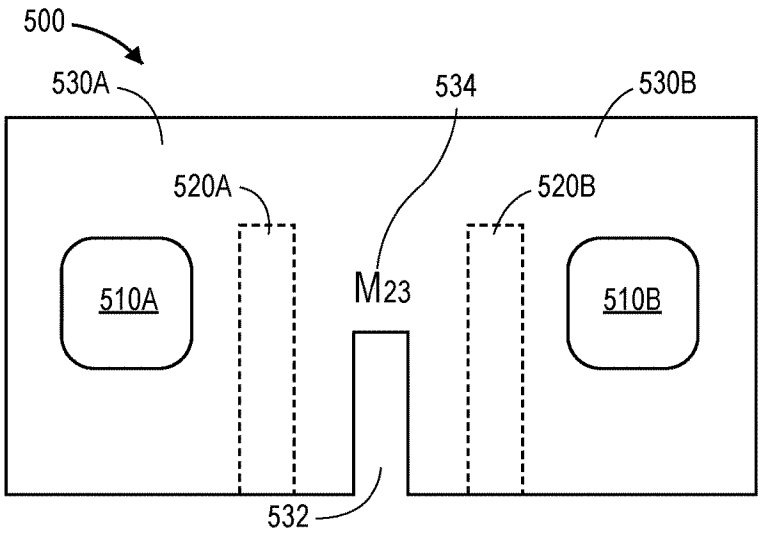
FIG. 5 is a top down view of two resonator pairs with parallel cylindrical resonators extending from a common side in accordance with an embodiment.

FIG. 5 illustrates assembly 500 with two resonator pairs, 530A and 530B. Cylindrical resonators 520A and 520B extend from a common side, and their axes are parallel. Partial-width dielectric window 534 is formed by channel 532, allowing $TE_{101}$ like modes to couple between ridge waveguide resonators 510A and 510B, which are farther away from each other within the dielectric block.

Figure 6:
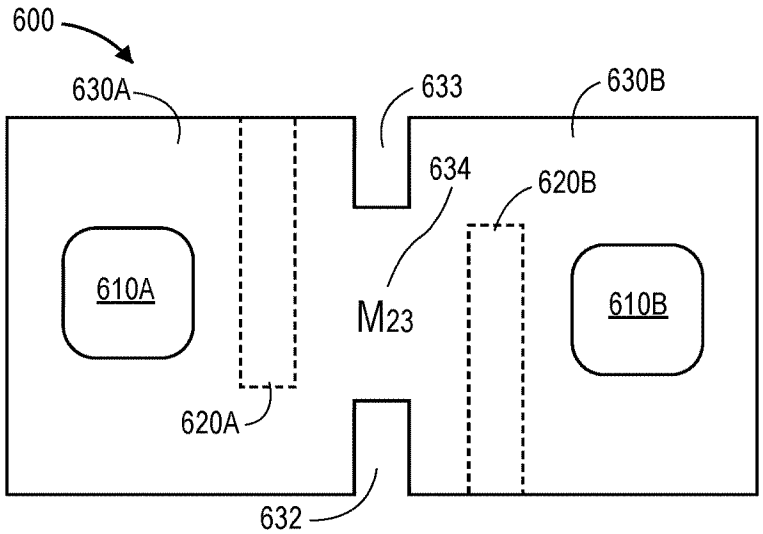
FIG. 6 is a top down view of two resonator pairs with parallel cylindrical resonators extending from opposite sides in accordance with an embodiment.

FIG. 6 illustrates assembly 600 with two resonator pairs, 630A and 630B. Cylindrical resonators 620A and 620B extend from opposite sides, and their axes are parallel. Partial-width dielectric window 634 is formed by channel 632 on the front side of the dielectric block and channel 633 on the back side. The partial width dielectric window allows $TE_{101}$ like modes to couple between ridge waveguide resonators 610A and 610B, which are far away from each other within the dielectric block.

Figure 7:
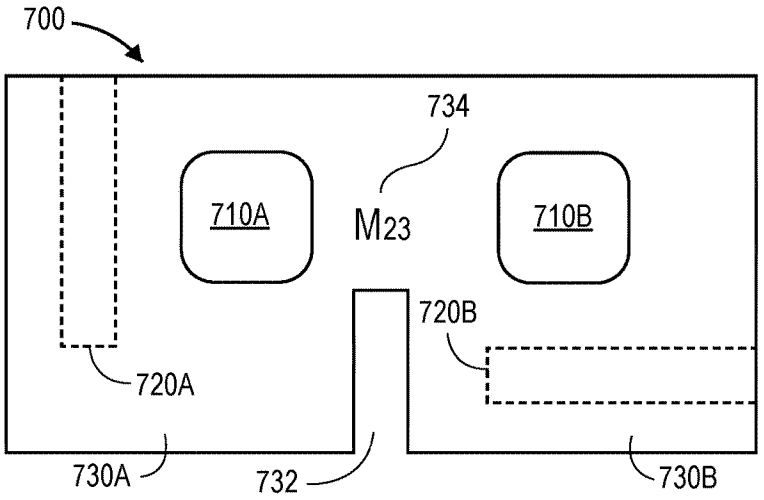
FIG. 7 is a top down view of two resonator pairs with perpendicular cylindrical resonators in accordance with an embodiment.

FIG. 7 illustrates assembly 700 with two resonator pairs, 730A and 730B. Cylindrical resonators 720A and 720B extend from adjacent and perpendicular sides, and thus their axes are perpendicular. Partial-width dielectric window 734 is formed by channel 732. The partial width dielectric window allows $TE_{101}$ like modes to couple between ridge waveguide resonators 710A and 710B, which are close together. Channel 732 blocks TEM modes from coupling between the cylindrical resonators.

Figure 8:
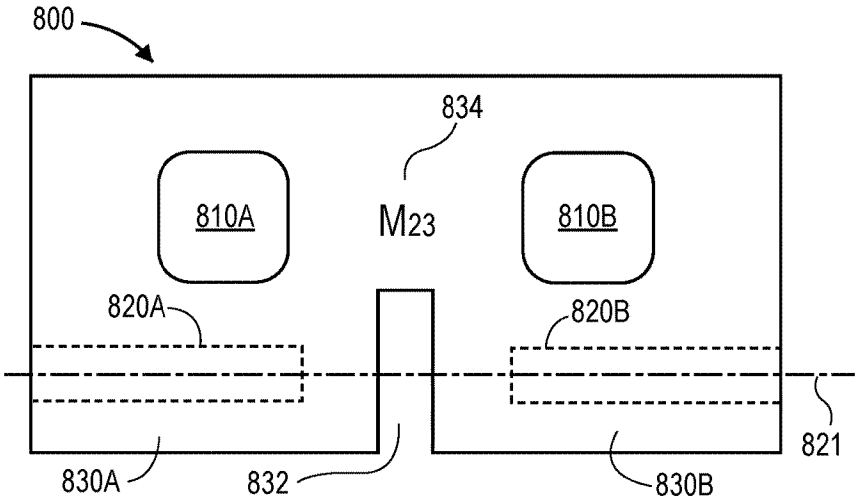
FIG. 8 is a top down view of two resonator pairs with cylindrical resonators that share a common axis in accordance with an embodiment.

FIG. 8 illustrates assembly 800 with two resonator pairs, 830A and 830B. Cylindrical resonators 820A and 820B extend from opposite sides and share common axis 821. Partial-width dielectric window 834 is formed by channel 832 and allows $TE_{101}$ like modes to couple between ridge waveguide resonators 810A and 810B, which are relatively close together. Channel 832 blocks TEM modes from coupling between the cylindrical resonators.

Figure 9A:
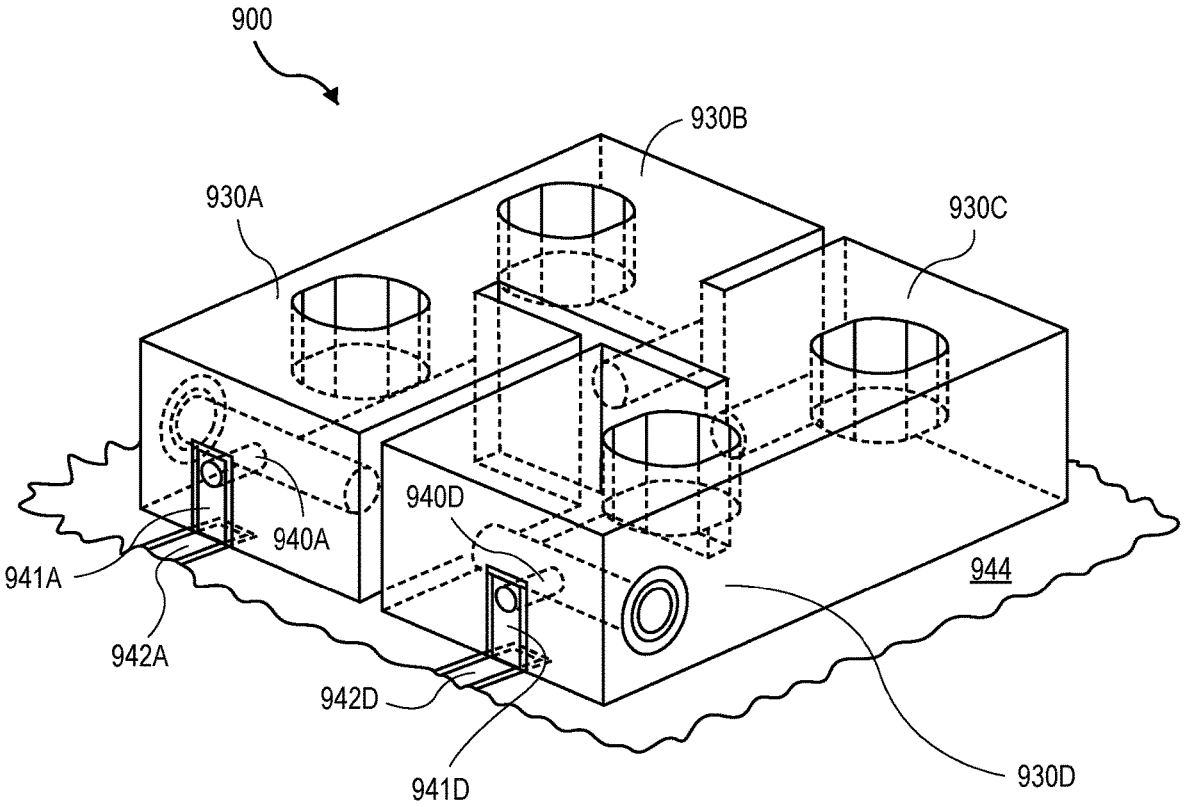
FIG. 9A is an isometric view of an 8-pole filter, comprising four resonator pairs, in accordance with an embodiment.
Figure 9B:
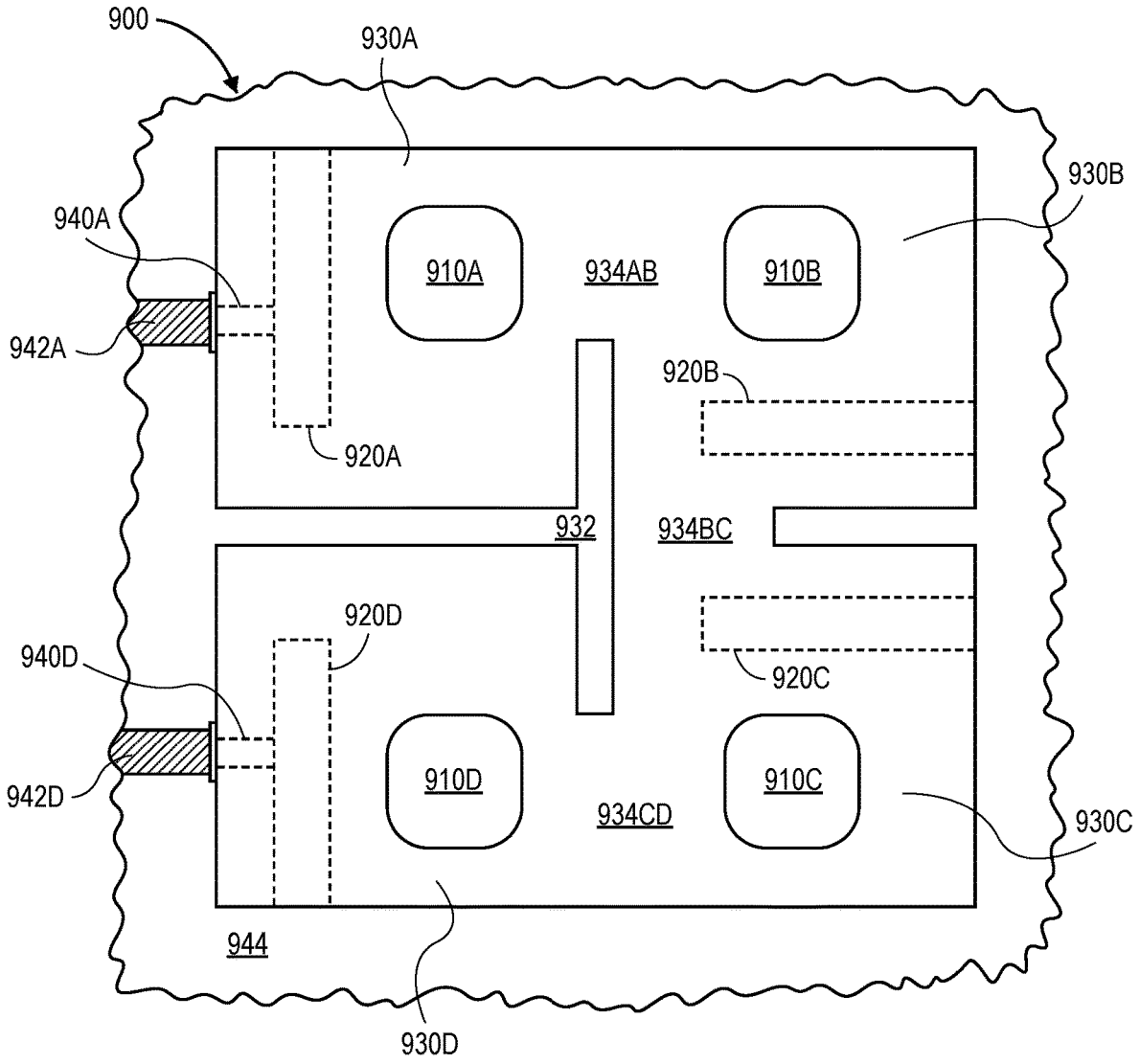
FIG. 9B is a top down view of the 8-pole filter of FIG. 9A.

FIGS. 9A-9B illustrate an 8-pole filter 900 formed by four resonator pairs, 930A, 930B, 930C, and 930D.

First resonator pair 930A includes ridge waveguide resonator 910A and horizontal cylindrical resonator 920A (see FIG. 9B), and second resonator pair 930B includes ridge waveguide resonator 910B and horizontal cylindrical resonator 920B. Third resonator pair 930C includes ridge waveguide resonator 910C and horizontal cylindrical resonator 920C, and fourth resonator pair 930D includes ridge waveguide resonator 910D and horizontal cylindrical resonator 920D.

Resonator pairs 930A and 930B are separated by partial-width dielectric window 934AB. Resonator pairs 930B and 930C are separated by partial-width dielectric window 934BC, and resonator pairs 930C and 930D are separated by partial-width dielectric window 934CD. T-shaped channel 932 in the dielectric block forms the partial-width windows.

With each building block (see FIG. 3) and the various coupling arrangements between adjacent resonator pairs (see FIGS. 4A-8), larger filters may be properly formed and adjusted. Thus, an 8-pole filter response can be obtained in a compact size as compared to a conventional dielectric waveguide filter. A great many of them can be integrated onto circuit boards or other substrates.

A coplanar waveguide circuit, with traces 942A and 942D, is formed on substrate 944 underneath the filter. Traces 942A and 942D are respectively connected via leads 941A and 941D on the sidewall of the resonator with metallic probes 940A and 940D. Metallic probes 940A and 940D respectively connect the waveguide circuit and the metalized cylindrical resonators 920A and 920D in each dielectric resonator pair 930A and 930D.

This input/output structure can produce a capacitive or inductive cross coupling at the input/output resonator. The polarity of the cross coupling can be controlled by adjusting the position of feeding probe 940A or 940D along the metalized cylindrical resonator 920A or 920D to which each probe is attached. By properly choosing the feeding position and adjusting the dimensions of the coplanar waveguide (CPW) circuit, the required input/output coupling can be achieved, and two transmission zeros can be obtained, one on each side of the passband. As is apparent from the figure, this CPW transmission line fed structure is suitable for surface mounting assembly processes.

Figure 10:
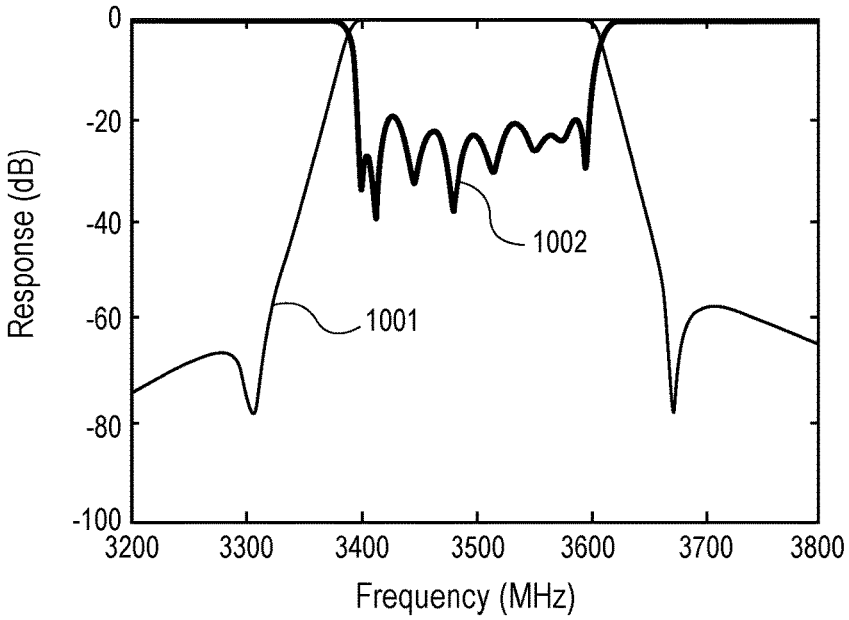
FIG. 10 is a frequency response chart produced from a simulation of the 8-pole filter of FIG. 9A.

FIG. 10 shows a typical frequency response of the 8-pole filter of FIG. 9A. Transmission coefficient 1001 has two zeros, one on each side of the pass band of 3400 and 3700 MHz. Reflection coefficient 1002 is better than −20 dB in the frequency range.

Figure 11:
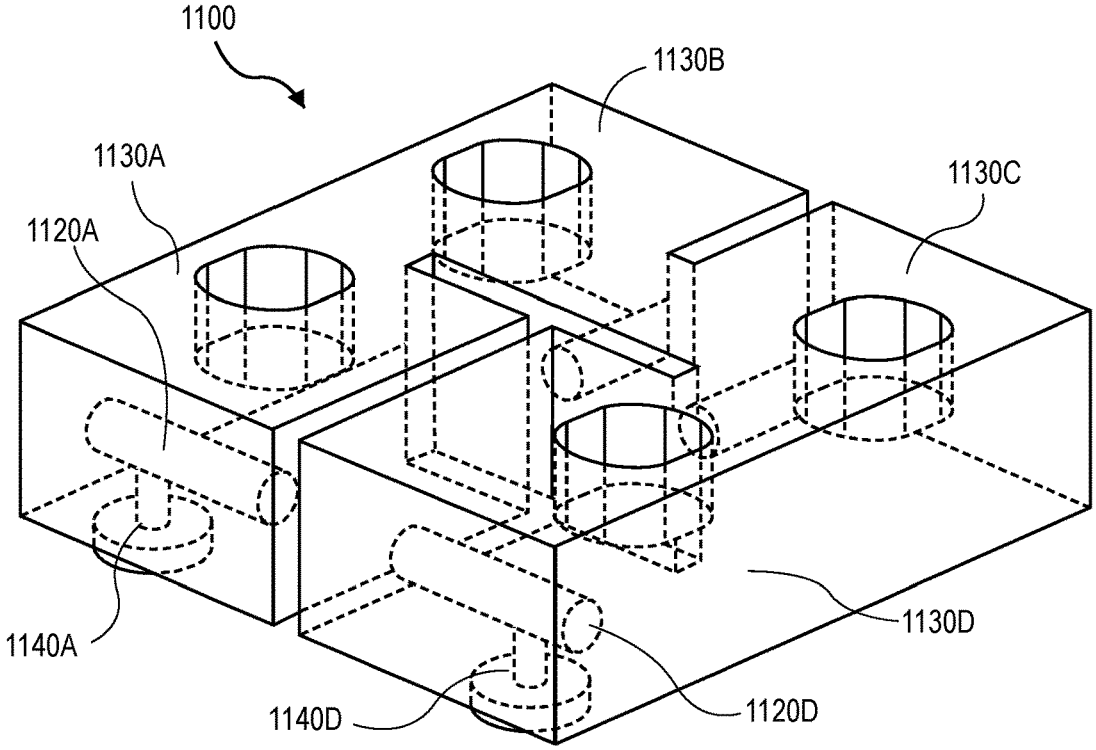
FIG. 11 is an isometric view of an 8-pole filter with buried ½λ, cylinders in accordance with an embodiment.

FIG. 11 illustrates an 8-pole filter 1100 with buried ½λ cylinders, "buried" meaning that neither end of each horizontal cylinder opens to the outside.

The filter is fed by a pair of coaxial feeding probes 1140A and 1140D inserted from the bottom of both terminal resonators 1130A and 1130D. The terminal resonators are connected to each other through a chain resonators, proceeding as follows: 1130A, 1130B, 1130C, and 1130D. The excitation structure can produce cross coupling in each input/output resonator, resulting in transmission zeros in the filter transmission response at either the lower side or the higher side of the passband. The transmission zero can improve the near pass band rejection rate of the filter. The position of the transmission zero is adjustable by adjusting the position of feeding probe 1140A or 1140D along the metal cylindrical resonator 1120A or 1120D to which each probe is attached.

Figure 12:
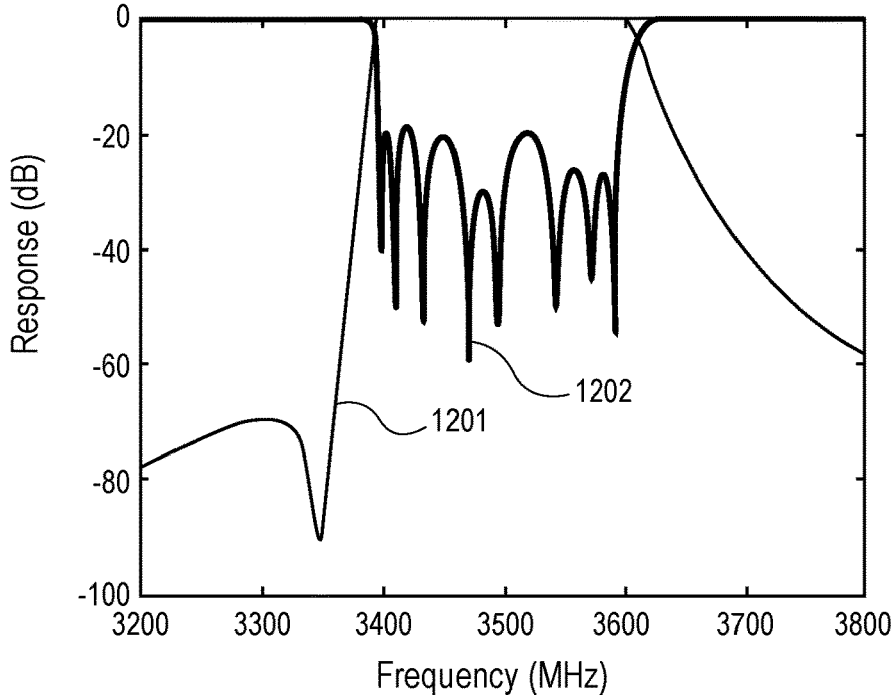
FIG. 12 is a frequency response chart produced from a simulation of the 8-pole filter of FIG. 11.

FIG. 12 is a frequency response chart produced from a simulation of the 8-pole filter of FIG. 11. Transmission coefficient 1201 has two zeros that coincide with each other at the lower side of the 3400-3700 MHz pass band. Reflection coefficient 1002 is better than −20 dB in the pass band.

Although specific embodiments of the invention have been described, various modifications, alterations, alternative constructions, and equivalents are also encompassed within the scope of the invention. Embodiments of the present invention are not restricted to operation within certain specific environments, but are free to operate within a plurality of environments. Additionally, although method embodiments of the present invention have been described using a particular series of and steps, it should be apparent to those skilled in the art that the scope of the present invention is not limited to the described series of transactions and steps.

Further, while embodiments of the present invention have been described using a particular combination of hardware, it should be recognized that other combinations of hardware are also within the scope of the present invention.

The specification and drawings are, accordingly, to be regarded in an illustrative rather than a restrictive sense. It will, however, be evident that additions, subtractions, deletions, and other modifications and changes may be made thereunto without departing from the broader spirit and scope.

What is claimed is:

1. A dielectric resonator filter apparatus comprising:
- a dielectric block having a top and sides;
- a right prism depression in the top of the dielectric block;
- a horizontal cylindrical cavity within the dielectric block, the horizontal cylindrical cavity having an axis that is parallel with the top of the dielectric block;
- a first conductive layer covering the dielectric block and the right prism depression; and
- a second conductive layer covering an inside surface of the horizontal cylindrical cavity, wherein the first conductive layer is electrically isolated from the second conductive layer,
- whereby the right prism depression is a ridge waveguide resonator that is dominated by a transverse electric ($TE_{101}$) mode, and the horizontal cylindrical cavity is configured to support a transverse electromagnetic (TEM) mode of electromagnetic waves within operating wavelengths of the dielectric resonator filter apparatus, the right prism depression configured to affect electromagnetic coupling between the $TE_{101}$ and TEM modes.

2. The apparatus of claim 1 wherein a length of the horizontal cylindrical cavity is about one half of the operating wavelengths.

3. The apparatus of claim 1 further comprising:
- an opening from an outside of the dielectric block to the horizontal cylindrical cavity.

4. The apparatus of claim 3 wherein the horizontal cylindrical cavity extends to one of the sides of the dielectric block and forms the opening.

5. The apparatus of claim 4 further comprising:
- an annular, insulative gap between the first conductive layer and the second conductive layer.

6. The apparatus of claim 1 further comprising:
- a coaxial feeding probe extending from an outside of the dielectric block to one of the sides or a bottom of the horizontal cylindrical cavity.

7. The apparatus of claim 1 wherein the right prism depression and the horizontal cylindrical cavity constitute a first resonator pair, the right prism depression being a first right prism depression, and the horizontal cylindrical cavity being a first horizontal cylindrical cavity, the apparatus further comprising:
- a second resonator pair in the dielectric block comprising a second right prism depression in the top of the dielectric block and a second horizontal cylindrical cavity within the dielectric block; and a partial-width dielectric window between the first and second resonator pairs, the partial-width dielectric window formed by a conductive, vertical channel in one or more of the sides of the dielectric block.

8. The apparatus of claim 7 wherein axes of the first and second cylindrical cavities are parallel, and the first and second cylindrical cavities extend from a common side of the dielectric block.

9. The apparatus of claim 7 wherein axes of the first and second cylindrical cavities are parallel, and the first and second cylindrical cavities extend from opposite sides of the dielectric block.

10. The apparatus of claim 7 wherein axes of the first and second cylindrical cavities are perpendicular to one another.

11. The apparatus of claim 7 wherein the first and second cylindrical cavities share a common axis, the first and second cylindrical cavities extend from opposite sides of the dielectric block, and the conductive, vertical channel bisects the common axis between the first and second cylindrical cavities.

12. The apparatus of claim 7 further comprising:

a third resonator pair in the dielectric block comprising a third right prism depression and a third horizontal cylindrical cavity;

a fourth resonator pair in the dielectric block comprising a fourth right prism depression and a fourth horizontal cylindrical cavity; and partial-width dielectric windows between multiple of the resonator pairs, each partial-width dielectric window formed by a conductive, vertical channel in one or more of the sides of the dielectric block, wherein axes of the first and second cylindrical cavities are perpendicular, axes of the second and third cylindrical cavities are parallel, and axes of the third and fourth cylindrical cavities are perpendicular, whereby the first, second, third, and fourth resonator pairs form an 8-pole dielectric resonator filter.

13. The apparatus of claim 12 further comprising:

a first feeding probe extending from outside the dielectric block to the first cylindrical cavity; and a second feeding probe extending from the outside to the fourth cylindrical cavity.

14. The apparatus of claim 13 wherein the first and second feeding probes extend to a bottom of the dielectric block.

15. The apparatus of claim 13 wherein the first and second feeding probes extend to one or more of the sides of the dielectric block, the apparatus further comprising:

flat conductive traces extending from the first and second feeding probes on the sides of the dielectric block to a bottom of the dielectric block, the flat conductive traces suitable for surface mounting of the dielectric resonator filter apparatus.

16. The apparatus of claim 1 wherein the right prism depression has a cross section of a circle, rectangle, or square.

17. The apparatus of claim 16 wherein the cross section is rectangular or square and has filleted or chamfered corners.

18. The apparatus of claim 1 wherein the dielectric block is rectangular.

19. The apparatus of claim 1 wherein the dielectric block comprises a material selected from the group consisting of ceramic, glass, or a polymer.

20. A transceiver comprising the dielectric resonator filter apparatus of claim 1.

21. A base station comprising the transceiver of claim 20.

* * * * *